US010676169B2

(12) United States Patent
Charles

(10) Patent No.: US 10,676,169 B2
(45) Date of Patent: Jun. 9, 2020

(54) SYSTEMS AND METHODS FOR RECREATIONAL PROPULSION DEVICE

(71) Applicant: Powerstick, Inc., Chandler, AZ (US)

(72) Inventor: Hester LeShawn Charles, Chandler, AZ (US)

(73) Assignee: Powerstick, Inc., Chandler, AZ (US)

( * ) Notice: Subject to any disclaimer, the term of this patent is extended or adjusted under 35 U.S.C. 154(b) by 0 days.

(21) Appl. No.: 16/051,729

(22) Filed: Aug. 1, 2018

(65) Prior Publication Data

US 2019/0016427 A1 Jan. 17, 2019

Related U.S. Application Data

(63) Continuation-in-part of application No. 15/410,627, filed on Jan. 19, 2017, now abandoned, which is a continuation of application No. 14/845,135, filed on Sep. 3, 2015, now abandoned, which is a continuation-in-part of application No. 14/745,117, filed on Jun. 19, 2015, now abandoned.

(60) Provisional application No. 62/113,666, filed on Feb. 9, 2015.

(51) Int. Cl.
*A63C 17/26* (2006.01)
*B63H 16/04* (2006.01)

(52) U.S. Cl.
CPC ..... *B63H 16/04* (2013.01); *A63C 17/26* (2013.01)

(58) Field of Classification Search
CPC ..... B63H 16/04; A63C 17/26
See application file for complete search history.

(56) References Cited

U.S. PATENT DOCUMENTS 3,448,749 A * 6/1969 Stark ..... A45B 9/04 135/70
3,677,216 A * 7/1972 Gentemann ..... B63H 16/04 440/102
4,319,750 A * 3/1982 Roy ..... A63B 53/10 473/320
4,411,159 A * 10/1983 Spear ..... G01L 1/2206 177/211
5,058,923 A * 10/1991 Dale ..... A63C 11/22 135/65
5,236,222 A * 8/1993 Fletcher ..... A63C 17/0013 135/77
5,236,223 A * 8/1993 Leon ..... A63C 11/22 280/819
5,331,989 A * 7/1994 Stephens ..... A45B 9/00 135/65
5,505,492 A * 4/1996 Nelson ..... A63B 53/10 280/819
5,534,203 A * 7/1996 Nelson ..... A63B 53/10 264/101
5,564,451 A 10/1996 Hagberg
5,653,468 A 8/1997 Ostapyk
5,788,608 A 8/1998 Wilkinson
(Continued)

*Primary Examiner* — Jacob B Meyer
(74) *Attorney, Agent, or Firm* — The Noblitt Group, PLLC

(57) ABSTRACT

A recreational power and stabilizing apparatus according to various aspects of the present technology includes an elongated handle body, a spring member coupled to the elongated handle body, and a traction element. The spring member comprises a compound curving element having a lower power region and a high power region. The traction element is coupled to the spring member and engages the ground during use.

12 Claims, 7 Drawing Sheets

(56) References Cited

U.S. PATENT DOCUMENTS 5,845,664 A 12/1998 Ryder et al.
5,938,240 A 8/1999 Gairdner
5,984,359 A * 11/1999 Faiks ..... A63C 11/22 135/86
6,042,438 A * 3/2000 Dean ..... B63H 16/04 416/74
6,306,178 B1 * 10/2001 Kania ..... A61F 2/60 623/27
6,733,042 B1 5/2004 Klemetti
7,896,013 B2 * 3/2011 Lerner ..... A45B 9/02 135/65
7,951,051 B1 * 5/2011 Brown ..... A63B 21/0004 482/111
7,954,502 B2 * 6/2011 Townsend ..... A61H 3/02 135/66
8,147,383 B2 * 4/2012 Bentley ..... A63B 5/06 482/18
8,210,997 B2 7/2012 Thomas et al.
8,636,305 B2 * 1/2014 Gonzalez ..... A63C 17/0013 280/219
8,636,306 B2 * 1/2014 McBride ..... A63C 17/0013 135/77
8,746,266 B2 * 6/2014 Palmer ..... A45B 9/04 135/82
8,814,212 B2 * 8/2014 Bennett ..... A63C 11/24 280/819
8,858,401 B2 10/2014 Kaupe
8,974,232 B2 * 3/2015 Behrenbruch ..... G06F 19/3481 434/258
9,498,700 B2 * 11/2016 Henrie ..... A63C 11/227
9,516,933 B2 12/2016 Woodall et al.
9,586,129 B2 * 3/2017 Henrie ..... A63C 11/227
9,763,502 B2 * 9/2017 Rudin ..... A45B 7/005
10,059,414 B2 * 8/2018 Henrie ..... A63C 11/227
10,064,781 B2 * 9/2018 Clausen ..... A61H 3/0288
10,137,355 B2 * 11/2018 Brennan ..... A63C 17/0013
2003/0227167 A1 * 12/2003 Redor ..... A63C 11/22 280/819
2004/0107981 A1 * 6/2004 Smith ..... A45B 9/00 135/65
2004/0250845 A1 * 12/2004 Rudin ..... A45B 7/005 135/77
2006/0090783 A1 5/2006 King-Fai
2007/0120352 A1 * 5/2007 Panizza ..... A63C 11/22 280/819
2007/0249472 A1 10/2007 Frei
2010/0123304 A1 5/2010 Ambuske et al.
2010/0206348 A1 * 8/2010 Markou ..... A61H 3/02 135/71
2011/0065341 A1 * 3/2011 Potter ..... B63H 16/04 440/101
2011/0101664 A1 * 5/2011 Gonzalez ..... A63C 17/0013 280/821
2012/0015785 A1 * 1/2012 Burroughs ..... A63C 11/221 482/139
2012/0024634 A1 * 2/2012 Walker ..... B63H 16/04 185/37
2012/0042918 A1 2/2012 Tessier
2012/0049502 A1 * 3/2012 Ascunce ..... A63C 17/0013 280/821
2012/0053018 A1 3/2012 Kaupe
2012/0139224 A1 * 6/2012 Weir ..... A63C 17/0013 280/821
2012/0160286 A1 6/2012 Ban
2012/0200073 A1 * 8/2012 Bennett ..... A63C 11/24 280/819
2012/0267872 A1 * 10/2012 McBride ..... B62M 29/00 280/219
2012/0326425 A1 12/2012 Cubillo
2014/0014148 A1 * 1/2014 Halonen ..... A45B 7/00 135/65
2014/0150834 A1 6/2014 Nootenboom
2014/0332045 A1 * 11/2014 Rudin ..... A45B 7/005 135/82
2015/0140890 A1 5/2015 Perlmutter
2015/0291268 A1 * 10/2015 Shoemaker ..... B63H 16/04 440/101
2016/0228759 A1 * 8/2016 Henrie ..... A63C 11/227
2016/0229507 A1 * 8/2016 Henrie ..... A63C 11/227
2017/0121001 A1 * 5/2017 Henrie ..... A63C 11/227
2017/0128818 A1 * 5/2017 Charles ..... A63C 17/0013
2017/0217511 A1 8/2017 Orlovskiy
2019/0016427 A1 * 1/2019 Charles ..... B63H 16/04
2019/0071159 A1 * 3/2019 Henrie ..... A63C 11/227

* cited by examiner

30

SYSTEMS AND METHODS FOR RECREATIONAL PROPULSION DEVICE

CROSS-REFERENCES TO RELATED APPLICATIONS

This application is a continuation-in-part of U.S. patent application Ser. No. 15/410,627, filed on Jan. 19, 2017, which is a continuation of U.S. patent application Ser. No. 14/845,135, filed on Sep. 3, 2015, which is a continuation-in-part of U.S. patent application Ser. No. 14/745,117, filed on Jun. 19, 2015, which claims the benefit of U.S. Provisional Patent Application No. 62/113,666, filed Feb. 9, 2015 and incorporates the disclosure of each application in their entirety by reference. To the extent that the present disclosure conflicts with any referenced application, however, the present disclosure is to be given priority.

BACKGROUND

Aspects of this document relate generally to apparatus for propelling individuals participating in walking, rolling, or sliding-based recreational activities. Skateboarders and other individuals participating in rolling/sliding-based recreational activities are often without apparatuses that will stabilize the user and provide power to the user in motion. Instead, the individuals must provide power themselves by using one leg to contact the ground and push the apparatus they're riding forward. Because one leg must remain on the apparatus, it may be difficult for some individuals to ride safely or for long periods of time without becoming tired.

SUMMARY

A recreational power and stabilizing apparatus according to various aspects of the present technology includes an elongated handle body, a spring member coupled to the elongated handle body, and a traction element. The spring member comprises a compound curving element having a lower power region and a high power region. The traction element is coupled to the spring member and engages the ground during use.

BRIEF DESCRIPTION OF THE DRAWING FIGURES

A more complete understanding of the present invention may be derived by referring to the detailed description when considered in connection with the following illustrative figures. In the following figures, like reference numbers refer to similar elements and steps throughout the figures.

Elements and steps in the figures are illustrated for simplicity and clarity and have not necessarily been rendered according to any particular sequence or scale. For example, steps that may be performed concurrently or in different order are illustrated in the figures help to improve understanding of embodiments of the present invention.

The figures described are for illustration purposes only and are not intended to limit the scope of the present disclosure in any way. Various aspects of the present invention may be more fully understood from the detailed description and the accompanying drawing figures, wherein.

DETAILED DESCRIPTION OF EXEMPLARY EMBODIMENTS

This disclosure, its aspects and implementations, are not limited to the specific components or assembly procedures disclosed herein. Many additional components and assembly procedures known in the art consistent with the intended apparatus and/or assembly procedures for a stabilizing and power apparatus will become apparent for use with implementations of stabilizing and power apparatuses from this disclosure. Accordingly, for example, although particular handles, bodies, coupling members, biased members, and shoes are disclosed, such handles, bodies, coupling members, biased members, and shoes and implementing components may comprise any shape, size, style, type, model, version, measurement, concentration, material, quantity, and/or the like as is known in the art for handles, bodies, coupling members, biased members, and shoes and implementing components, consistent with the intended operation of a stabilizing and power apparatus.

Figure 1:
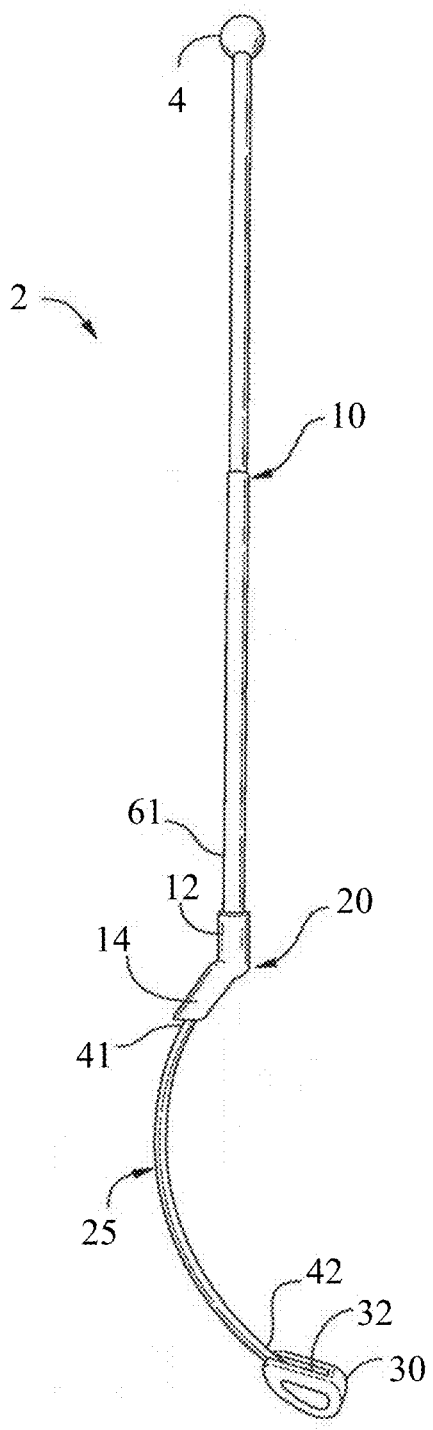
FIG. 1 is a side view of a recreational power and stabilizing apparatus in accordance with an exemplary embodiment of the technology.

Contemplated as part of this disclosure is an apparatus configured to provide power and balance or stabilization to a user participating in an athletic and/or movement-based activity. For example, the apparatus may be utilized by an individual walking or riding on a device such as: a skateboard, long board, rollerblades, roller skates, snowboard, and the like. Operation and advantages of the apparatus will become apparent to one of ordinary skill in the art upon review of the disclosures presented in this document. Referring to FIG. 1, generally, one or more embodiments of a recreational power and stabilizing apparatus 2 comprise a handle grip 4, a handle body 10 coupled to the handle grip 4, a coupling member 20 coupled to the handle body 10, a spring 25 coupled to the coupling member 20, and a sock 30 coupled to a lower end 42 of the spring 25.

The spring 25 comprise any configuration that allows the spring 25 to store kinetic energy from the user applying pressure to the spring 25 from the handle grip 4 or handle body 10 as potential energy. For example, the user may apply pressure to the spring 25 while in motion (such as a when rolling on a long board) by pushing the sock 30 against the ground or other surface, thus deforming/compressing the shape of and loading energy into the spring 25. As the user continues in motion beyond the contact point of the sock 30 and the ground, the spring 25 regains its shape and transfers a force or energy to the user in motion, thus propelling the user.

The spring 25 may comprise any biasing member known in the art, such as but not limited to a non-linear spring or elastic strap. In a first embodiment depicted in FIG. 1, the spring 25 comprises a bowed or arced leaf spring. As used herein, a coil spring is a linear biased member and not a non-linear or bowed biased member because when it is compressed axially, its force is exerted axially. As used herein, a curve or arc of the spring 25 is to be understood to extend beyond the end of the spring 25 itself so that it intersects with the axis of the handle body 10. In one or more embodiments, the spring 25 comprises an arc that extends longitudinally relative to the axis of the handle body 10, contrary to the coils of a coil spring, which would extend latitudinally relative to the axis of the coil spring. It is further contemplated that the spring 25 may comprise an angled, non-linear biased member.

In an alternative embodiment, the spring 25 may comprise a spring body forming a compound curve having at least one inflection point and multiple radiuses of curvature. Incorporating multiple radiuses of curvature into the spring 25 may provide varying levels of propelling force to the user. The propelling force may be applied in stages as different sections of the spring 25 compress and/or decompress in response to an applied load. This staged effect may provide for a smoother transfer of stored energy from the spring 25 as compared to a spring having only a single curve. Each radius of curvature $R_1$, $R_2$, $R_3$ may correspond to a unique power point and respond differently under the applied load.

Figure 2:
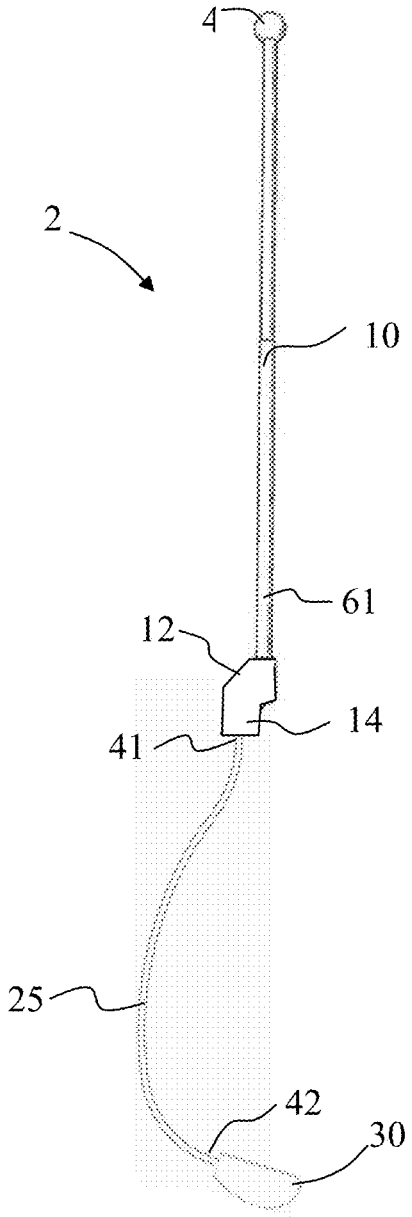
FIG. 2 is a side view of an alternative embodiment of the recreational power and stabilizing apparatus in accordance with an exemplary embodiment of the technology.
Figure 3:
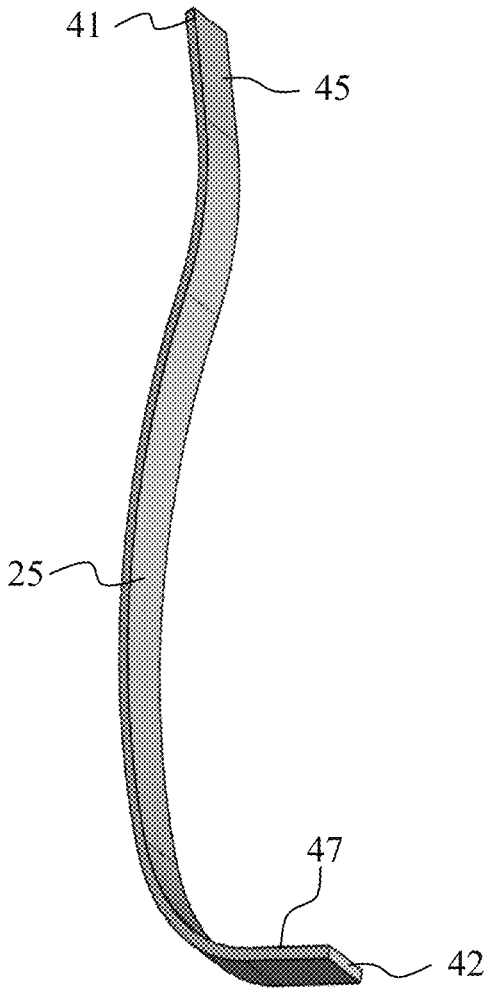
FIG. 3 is a perspective view of a spring in accordance with an exemplary embodiment of the technology.
Figure 4:
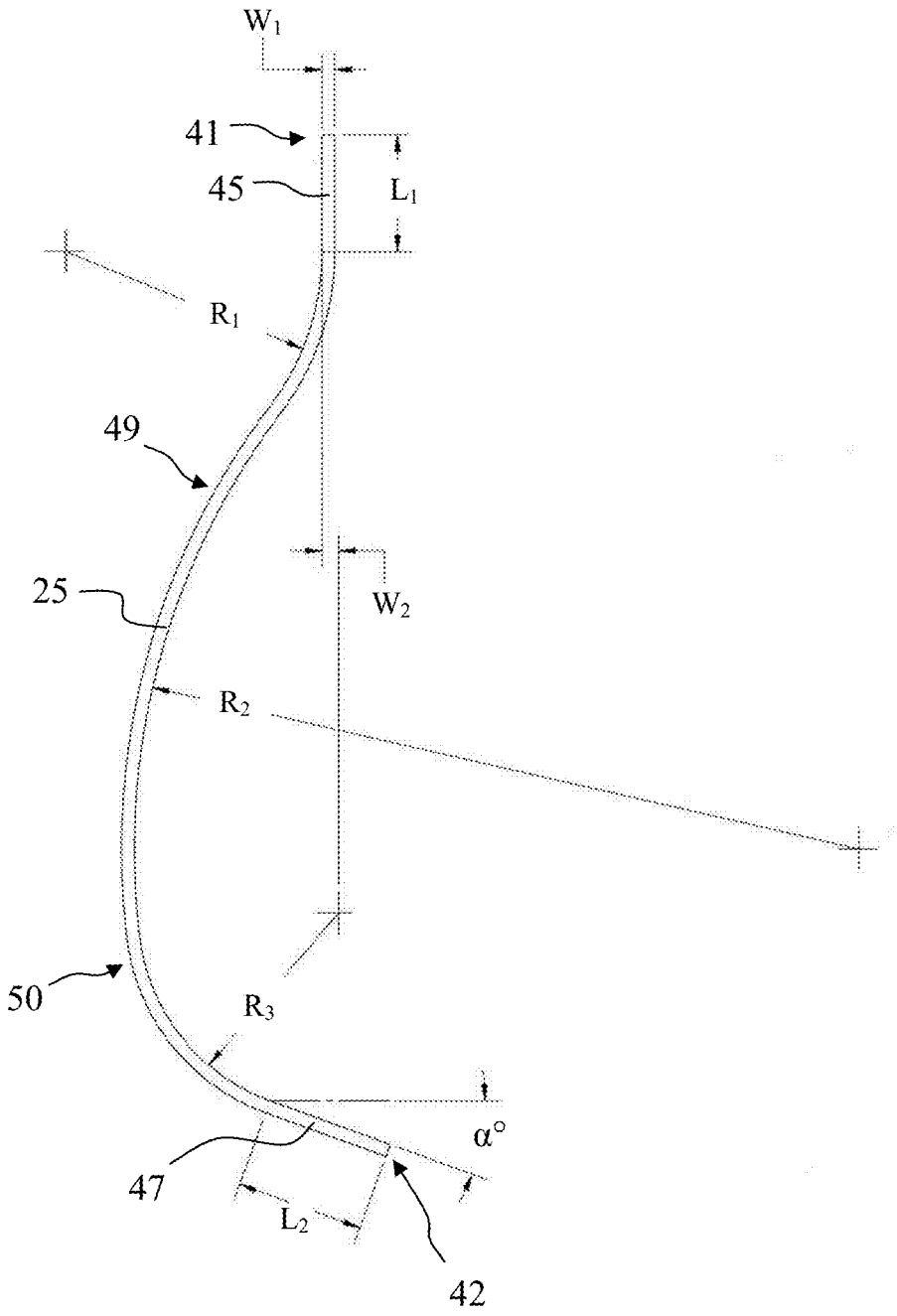
FIG. 4 is a side view of the spring in accordance with an exemplary embodiment of the technology.
Figure 5A:
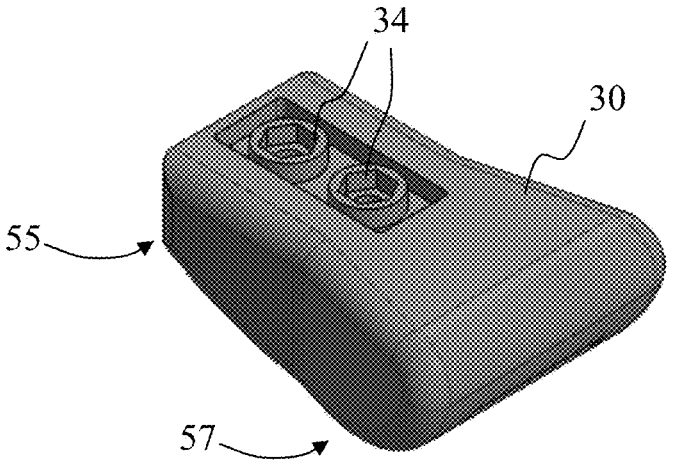
FIG. 5A is a top perspective view of a sock in accordance with an exemplary embodiment of the technology.
Figure 5B:
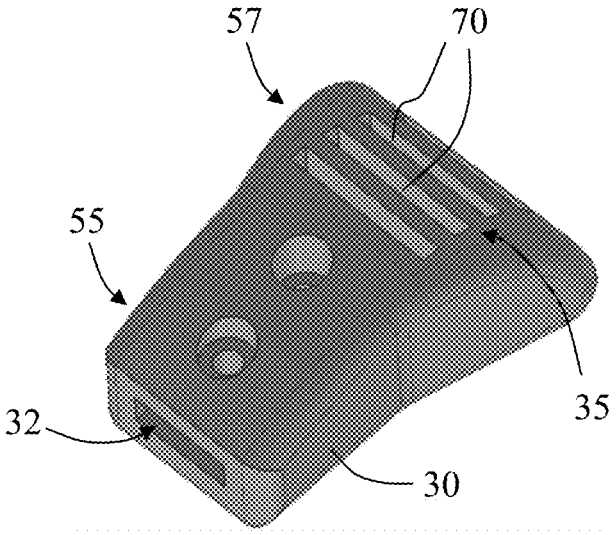
FIG. 5B is a bottom perspective view of the sock in accordance with an exemplary embodiment of the technology.
Figure 6A:
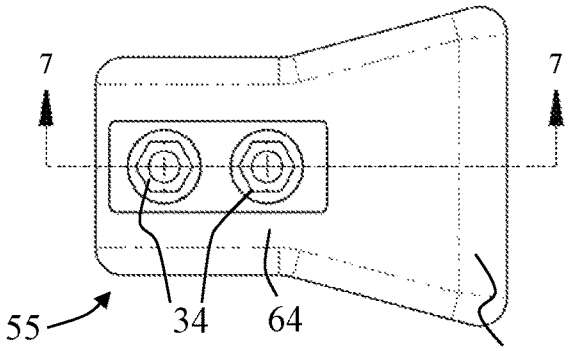
FIG. 6A is a top view of the sock in accordance with an exemplary embodiment of the technology.
Figure 6B:
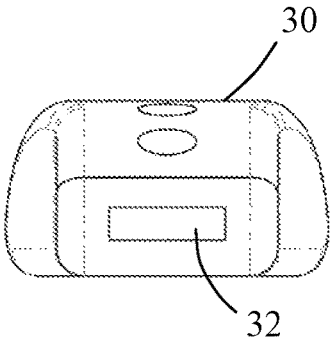
FIG. 6B is a rear view of the sock in accordance with an exemplary embodiment of the technology.
Figure 6C:
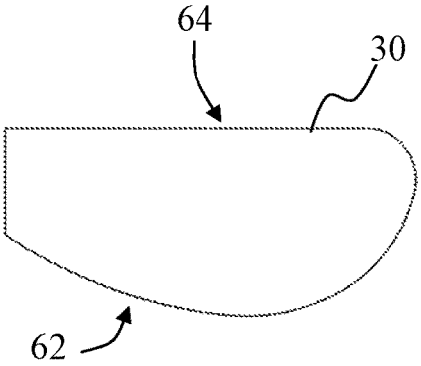
FIG. 6C is a side view of the sock in accordance with an exemplary embodiment of the technology.
Figure 6D:
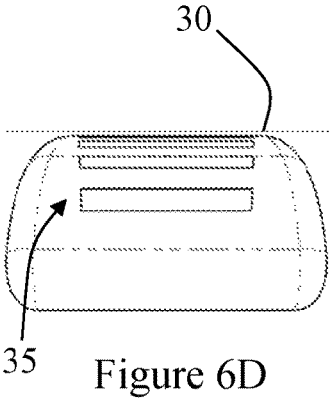
FIG. 6D is a front view of the sock in accordance with an exemplary embodiment of the technology.
Figure 6E:
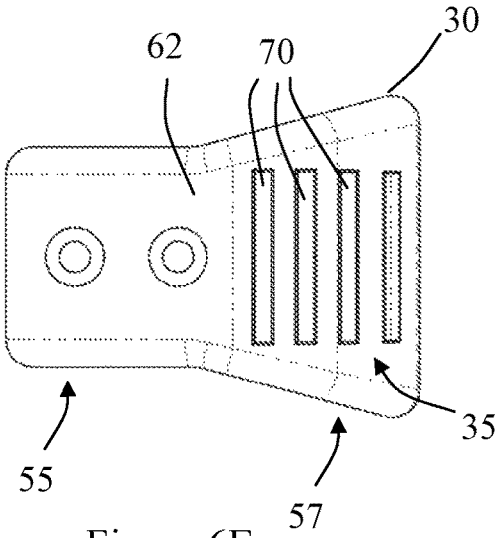
FIG. 6E is a bottom view of the sock in accordance with an exemplary embodiment of the technology.
Figure 7:
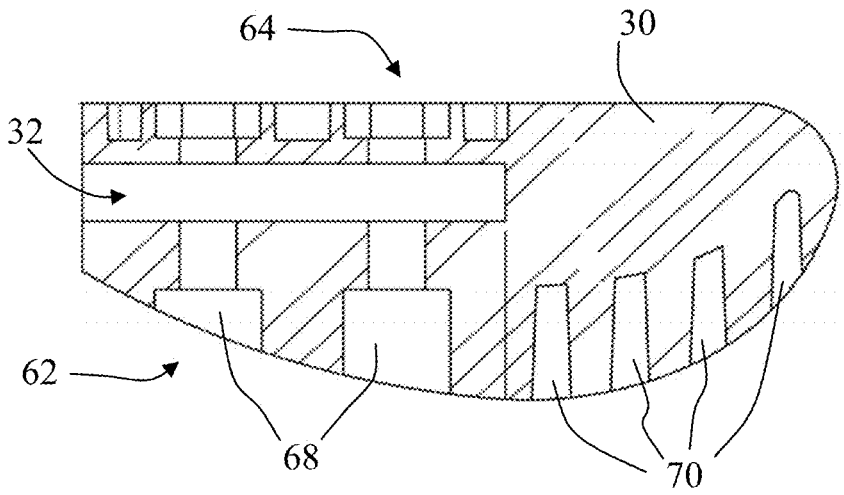
FIG. 7 is a cross-sectional across line 7-7 of FIG. 6A.

For example, referring now to FIGS. 2-4, the spring 25 may comprise a compound curve having one inflection point 49, three differing radiuses of curvature $R_1$, $R_2$, $R_3$, and at least two adjacent curves disposed on the same side of the inflection point 49. A first radius of curvature $R_1$ may be positioned near an upper end 41 of the spring 25. A first center of curvature for the first radius of curvature $R_1$ may be positioned rearward of the upper end 41 when the spring 25 is positioned in an upright manner. The rearward facing first center of curvature causes the spring 25 to initially form a first simple curve such that the body of the spring 25 is positioned behind the upper end 41.

As the spring 25 progresses downward, the body of the spring 25 passes through the inflection point 49 and a second simple curve in the opposite direction is formed. The result is that a second center of curvature for the second radius of curvature $R_2$ is positioned forward of the upper end 41. At a point of compound curvature 50, the body of the spring 25 may begin to curve along a different arc than that of the second radius of curvature $R_2$ forming a third simple curve proximate the lower end 42 of the spring 25 and corresponding to the third radius of curvature $R_3$.

The spring 25 may also comprise a straight upper end portion 45 and a straight lower end portion 47. The straight upper end portion 45 may be formed tangent to the first simple curve that extends to the upper end 41. Similarly, the straight lower end portion 47 may be formed tangent to the third simple curve that extends to the lower end 42.

The different radii of curvature create varying levels of force required to compress the spring 25. The amount of force required to compress a section of the spring 25 may correspond to the radius of curvature associated with a given simple curve. In general, a longer radius of curvature may require a greater loading force before that section of the spring 25 compresses and a shorter radius of curvature may require a relatively lower loading force to compress the spring 25.

The third radius of curvature $R_3$ may be associated with a low power region and the second radius of curvature $R_2$ may be associated with a high power region. Each power region is configured respond to a different activation/compression force. In one embodiment, if the third radius of curvature $R_3$ is less than the second radius of curvature $R_2$, then the portion of the spring 25 that curves around the third radius of curvature $R_3$ will have a lower response region and will begin to compress under an applied load in a first stage before the portion of the spring 25 that curves around the second radius of curvature $R_2$. As the applied load increases beyond a predetermined limit, the portion of the spring 25 that curves around the second radius of curvature $R_2$ will begin to compress in a second stage.

The power ratio between the low and high power regions may be adjusted by factors such as: the individual radiuses of curvature corresponding to the respective power region, the material the spring 25 is made from, the spring constant, the thickness of the spring 25, and/or the width of the spring 25. For example, the spring constant may change along the length of the spring 25 if the width and/or thickness of the spring 25 is changed in a given region. If a width and thickness of the spring 25 is constant between the upper and lower ends 41, 42, then a power ratio between the high and low power region can be created to help control the amount of force the spring 25 generates in response to an applied load. The power ratio between the low and high power regions can be set according to any desired criteria such as: a rider's height, weight, skill level, or a desired reaction rate of the spring 25 to an applied load.

For example, in one embodiment, the third radius of curvature $R_3$ may comprise a radius between 4.5-5.0 inches (114.3-127 mm) and the second radius of curvature $R_2$ may comprise a radius between 16.5-17.5 inches (419.1-444.5 mm) and result in a power ratio of about 4:1. At this ratio, if the low power region is configured to begin compressing under a load of about 4 pounds (1.8 kg) of force, then the high power region will not begin compressing until the applied load reaches 16 pounds (7.3 kg) of force. Similarly, if the low power region is configured to begin compressing under a load of about 6 pounds (2.7 kg) of force, then the high power region will not begin compressing until the applied load reaches 24 pounds (10.9 kg) of force.

Alternatively, the power ratio may be altered by changing the radiuses of curvature for the second and third radiuses of curvature $R_2$, $R_3$. For example, reducing the second radius of curvature $R_2$ relative to the third radius of curvature $R_3$ may reduce the power ratio such as 3:1 or 2:1 causing the second stage of spring 25 compression to begin at a lower threshold. Conversely, increasing the second radius of curvature $R_2$ relative to the third radius of curvature $R_3$ may increase the power ratio up to a higher level (e.g. 5:1, 7:1, etc.).

The spring 25 may further comprise a third power region corresponding to the first radius of curvature $R_1$ and a third stage of compression. For example, if the portion of the spring 25 in the high power region is fully compressed, the spring 25 may further compress around the first radius of curvature $R_1$ if the applied loading exceeds a threshold force for the high power region. Alternatively, the spring 25 may begin to compress in the third power region before the portion of the spring 25 in the high power region is fully compressed. For example, if the compression in the high power region reaches a threshold force loading, a lower relative radius associated with the first radius of curvature $R_1$ may allow the spring 25 to begin compressing in this region simultaneously with the high power region such that both regions are being compressed and dividing up the applied load across both regions.

The amount of compression in the third power region may be at least partially controlled by a length $L_1$ of the straight upper end portion 45. For example, a longer length of $L_1$ may provide a large moment arm around the first radius of curvature $R_1$ than a shorter length which would allow the user to generate more force around the first radius of curvature $R_1$.

In use, as the sock 30 engages the ground, the user may press down on the handle body 10 to compress the spring 25. In response to the initial loading, the spring 25 may begin to compress around the low power point first. Once the applied load reaches the predetermined level, the second stage of compression may begin. In an alternative embodiment, however, initiation of the second stage of compression may be affected by other factors. For example, the straight lower end portion 47 forms an angle "α" relative to the ground when the spring 25 is positioned in an upright manner. The length "$L_2$" of the straight lower end portion 47 may be used to limit the amount of compression the low power region may experience. A shorter length of the straight lower end portion 47 may allow relatively greater compression of the low power region than might be allowed if $L_2$ was lengthened since a lower surface of the straight lower end portion 47 would engage the ground before section of the spring 25 in the low power region could be fully compressed.

Alternatively, a mechanical element may be used to limit the amount of compression in the low power region. For example, a stop (not shown) might be positioned on a lower surface of the spring 25 aft of the sock 30. As the first stage of compression begins, the stop may move towards the ground and prevent any further compression of the low power region after the stop contacts the ground. This may be helpful to a user by allowing the high power region to engage at a lower applied force than might be required without the stop.

The spring 25 may comprise any of a number of materials known in the art, such as but not limited to metals, plastics, composites, and the like. In one or more embodiments, the spring 25 may comprise fiberglass or carbon fiber (such as a carbon fiber-reinforced polymer). The spring 25 may vary in size and dimensions according to any suitable criteria such as the desired weight-rated spring loads for different users.

Referring now to FIGS. 5A-7, the sock 30 provides a contact surface between the spring 25 and the ground. In combination with the spring 25, the user may create a propulsive force by reaching the sock 30 forward to engage the ground. The user then pushes (or loads) the spring 25 as the user continues past the sock 30 engaged with the ground until the spring 25 releases (or springs) and transfers additional force to the user.

The sock 30 may comprise a substantially flat top surface 64 and a curved bottom surface 62 with rounded sidewalls disposed between the top surface 64 and the bottom surface 62. The curved bottom surface 62 may comprise a simple curving surface or a compound curving surface. For example, referring now to FIG. 7, the rear portion 55 of the sock 30 may comprise a first curving surface and the forward portion 57 may comprise a second curving surface having a smaller radius than that of the first curving surface. The radius of the first and second curving surface may be selected according to any suitable criteria such as to help control how quickly the sock 30 rolls over the ground or to control how much surface area of the bottom surface 62 is in contact with the ground during various stages of the compression of the spring 25.

In one or more embodiments, the sock 30 comprises a slot 32 configured to receive and/or couple to the lower end 42 of the spring 25. The slot 32 may be sized such that a portion of the lower end 42 of the spring 25 fits within the slot 32. The slot 32 may be positioned along a rear portion 55 of the sock 30 and extend into an interior portion of the sock 30. The sock 30 may comprise any suitable dimensions and may vary according to an intended user's size, weight, or performance level. For example, in one embodiment, the sock 30 may comprise a length of between 2.5 inches (63.5 mm) and 4.5 inches (114.3 mm), a width of between 2 inches (50.8 mm) and 4 inches (101.6 mm), and a height of at least 1 inch (25.4 mm).

One or more couplings 34 may be used to secure the second end 42 of the spring 25 to the sock 30, such as but not limited to nuts and bolts, screws, pins, and the like and/or any combination thereof. The sock 30 may comprise one or more recessed ports 68 configured to receive the couplings 34. The one or more couplings 34 may extend all the way between the top surface 64 and the bottom surface 62 side of the sock 30 or may extend only partially into the sock 30. Alternatively, one or more couplings may be used to couple a spring 25 to a surface of the sock 30 devoid of a slot 32. In other embodiments, a sock 30 may comprise a pin or other member proximate a terminating end of the slot or a bracket, the pin (not shown) or other member being configured to support the spring 25 within the slot or bracket between the sidewalls of the slot bracket, the center wall of the slot or bracket, and the pin. According to some non-limiting aspects, a sock 30 is configured to be removably coupled to the spring 25, thus allowing a user to alternate between different sock 30 configurations depending on the terrain and/or wear on the sock 30.

In one or more embodiments, the sock 30 further comprises a traction element 35 disposed along the bottom surface 62 of a forward portion 57. The traction element 35 is configured to increase traction between the sock 30 and the ground, or other surface against which the traction element 35 will engage. According to some aspects, the traction element 35 is curved, either with a curve of the bottom surface 62 of the sock 30 or independent of the sock 30. The traction element 35 may comprise any suitable material such as a durable rubber or rubber-molded body that is soft enough that it does not slip against typical surfaces but strong enough that it is does not easily degrade or tear apart.

Referring now to FIGS. 5B, 6A-E and 7, in one embodiment, the traction element 35 may comprise a series of recesses 70 extending into the bottom surface 62 of the forward portion 57. The recesses 70 may comprise any shape or size and may be arranged along the length of the sock 30 or along the width of the sock 30. For example, each recess 70 may comprise a substantially rectangular shaped opening in the bottom surface 62 of the forward portion 57 and extend into the sock 30 forming an open channel in the bottom surface 62. Sidewalls of the recesses 70 may collapse slightly and/or compress towards each other during use as the sock 30 engages the ground to provide enhanced grip along the forward portion 57 as the sock 30 rolls from the rear portion 55 of the bottom surface 62 to the forward portion 57.

For example, during use, as the user extends the sock 30 towards the ground, the rear portion 55 of the sock 30 may contact the ground first. As the user loads the spring 25, the sock 30 will roll or rotate along the curved bottom surface 62 until the forward portion 57 is contacting the ground. As the loading on the spring 25 increases, the recesses 70 may allow the forward portion 57 to deform slightly increasing contact area between the bottom surface 62 and the ground.

A width of the forward portion 57 may increase from a mid-portion of the sock 30 to an end of the forward portion 57 to provide a larger contact area. For example, the sidewalls of the sock 30 may angle outward from the mid-portion in a trapezoidal manner such that the end of the sock 30 at the forward portion 57 is wider than the end of the sock 30 at the rear portion 55. In one embodiment, the sidewalls of the forward portion 57 of the sock 30 may form an angle between each other of about 20 to 40 degrees.

In one or more embodiments, the sock 30 may be pivotally coupled to the spring 25. For example, the sock 30 may be coupled to the spring 25 with a single bolt 34. In such embodiments, the slot 32 may be sized to allow the second end 42 of the spring 25 to pivot within the slot 32. The walls of the slot 32, however, prevent the second end 42 of the spring 25 from pivoting beyond a desired angle. Such a configuration is advantageous because it allows the sock 30 to rotate or pivot slightly when the sock 30 contacts the ground if the handle body 10 and spring 25 are at an angle, thus providing an increased surface area of contact between the sock 30 and the ground. In other embodiments, screw holes extending through the sock 30 may comprise slotted holes that allow the sock 30 to pivot upon contact with the ground.

The handle body 10 is configured to allow the user to direct the spring 25 and/or sock 30 during use, as well as hold the recreational power and stabilizing apparatus 2. According to some aspects, the handle body 10 comprises a shafted handle body 10 coupled to the spring 25. More particularly, the handle body 10 may comprise a substantially straight and cylindrical aluminum shafted body. In other embodiments, the handle body 10 may comprise other various shapes, materials, and geometric configurations. For example, the handle body 10 may comprise other materials such as but not limited to plastics, carbon fiber material, wood, metal, and the like.

The handle body 10 may further comprise a handle grip 4 coupled to the handle body 10. The handle grip 4 may comprise any handle known in the art that provides an improved gripping function for the user. The handle grip 4 may comprise a substantially spherical body coupled to an upper end the handle body 10 opposite the spring 25. Some embodiments, however, may be devoid of such a handle. Other embodiments may comprise a second handle positioned on the handle body 10 between the first handle grip 4 and the coupling member 20. Regardless of the shape or configuration, the handle grip 4 may be fixed or rotatable to adapt to different grasping positions. In some embodiments, the handle grip 4 may be grip shaped and have indentations for finger grips or be oblong shaped like a typical boat paddle handle.

The coupling member 20 is configured to couple the handle body 10 to the spring 25. The coupling member 20 may comprise one or more of a variety of materials, such as but not limited to any plastics, carbon fiber material, metals, and the like known in the art. The coupling member 20 may comprise any coupling member configured to couple the handle body 10 to the spring 25 and is not limited to the coupling member 20 demonstrated in FIGS. 1 and 2. According to some aspects, the coupling member 20 comprises a first leg 12 configured to couple to the handle body 10 and a second leg 14 configured to couple to a spring 25. The first leg 12 and the second leg 14 may comprise any configuration for coupling the handle body 10 and the spring 25, respectively, to the coupling member 20.

Referring now to FIG. 2, the first end 41 of the spring 25 may be coupled to the handle body 10 such that the first end 41 of the spring 25 is offset from a lower end 61 of the handle body 10 and/or a longitudinal axis of the handle body 10. More particularly, the coupling member 20 may comprise a first leg, a second leg shorter than the first leg and approximately 90 degrees from the first leg, and a third hypotenuse leg extending from the first leg to the second leg. According to some aspects, the coupling member 20 comprises a body receiver or coupling proximate an intersection of the first leg and the hypotenuse leg. The body receiver may comprise a hole, one or more screws, one or more pins, one or more nuts and bolts, any combination thereof, or any other receiver or coupling known in the art and configured to couple the coupling member 20 to the handle body 10. According to some aspects, the coupling member 20 further comprises a biased member receiver proximate an intersection of the second leg and the hypotenuse leg of the coupling member. The biased member receiver may comprise a hole, one or more screws, one or more pins, one or more nuts and bolts, any combination thereof, or any other receiver or coupling known in the art and configured to couple the spring 25 to the coupling member 20.

The technology has been described with reference to specific exemplary embodiments. Various modifications and changes, however, may be made without departing from the scope of the present technology. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any order, unless otherwise expressly specified, and are not limited to the explicit order presented in the specific examples. Additionally, the components and/or elements recited in any apparatus embodiment may be assembled or otherwise operationally configured in a variety of permutations to produce substantially the same result as the present technology and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A recreational power and stabilizing apparatus, comprising:

an elongated handle body;

a spring, wherein the spring comprises:

an upper end coupled to a lower end of the elongated handle body;

a lower end;

a first curving section having a first radius of curvature and disposed proximate the upper end;

a second curving section having a second radius of curvature and disposed below and adjoining the first curving section;

an inflection point disposed between the first and second curving sections;

a third curving section having a third radius of curvature and disposed below and adjoining the second curving section and above and adjoining the lower end, wherein:

the second radius of curvature is greater than the first and third radiuses of curvature;

the second and third radiuses of curvature are located on a same side of the spring and opposite the first radius of curvature;

the third radius of curvature corresponds to a first stage of spring compression in a low power region;

the second radius of curvature corresponds to a second stage of spring compression in a high power region; and the low power region will begin to compress under an applied load in the first stage before the high power region begins to compress in the second stage; and a sock coupled to and supported by the lower end of the spring.

2. The recreational power and stabilizing apparatus of claim 1, wherein the sock comprises:

a rear portion;

a forward portion;

a slot disposed along and extending into the rear portion, wherein the slot is configured to receive the lower end of the spring into the rear portion; and a traction element disposed along a bottom surface of the forward portion.

3. The recreational power and stabilizing apparatus of claim 2, wherein the traction element comprises a series of inwardly extending recesses disposed along the bottom surface of the forward portion.

4. The recreational power and stabilizing apparatus of claim 3, wherein each inwardly extending recesses comprises a substantially rectangular shaped opening in the bottom surface of the forward portion.

5. The recreational power and stabilizing apparatus of claim 2, wherein a width of the forward portion increases from a mid-portion of the sock to an end of the forward portion.

6. The recreational power and stabilizing apparatus of claim 2, wherein:

a top surface of the sock is flat between a first end at the rear portion and a second end at the forward portion; and the bottom surface of the sock is curved between the first and second ends.

7. The recreational power and stabilizing apparatus of claim 1, wherein the third radius of curvature is less than the second radius of curvature.

8. The recreational power and stabilizing apparatus of claim 7, wherein the third radius of curvature is less than the first radius of curvature.

9. The recreational power and stabilizing apparatus of claim 1, wherein:

a center of curvature for the first radius of curvature is disposed rearward of the elongated handle body;

a center of curvature for the second radius of curvature is disposed forward of the elongated handle body; and a center of curvature for the third radius of curvature is disposed proximate a longitudinal axis of the elongated handle body.

10. The recreational power and stabilizing apparatus of claim 1, further comprising:

a straight upper end portion extending from the upper end to the first curving section; and a straight lower end portion extending from the third curving section to the lower end of the spring.

11. The recreational power and stabilizing apparatus of claim 10, wherein the straight lower end portion forms an angle between five and twenty-five degrees with the ground when the elongated handle body is positioned perpendicular to the ground.

12. The recreational power and stabilizing apparatus of claim 1, further comprising a coupling element coupling the upper end of the spring to the lower end of the elongated handle body.

* * * * *